US006202535B1

(12) United States Patent
Alhadef et al.

(10) Patent No.: US 6,202,535 B1
(45) Date of Patent: Mar. 20, 2001

(54) DEVICE CAPABLE OF DETERMINING THE DIRECTION OF A TARGET IN A DEFINED FRAME OF REFERENCE

(75) Inventors: Bernard Alhadef, Le Castellet; Guy Philibert, La Seyne sur Mer, both of (FR)

(73) Assignees: L'Etat Francais, represente par le Delegue Ministeriel pour l'Armement, Armees; Sofresud, Ollioules, both of (FR)

( * ) Notice: Subject to any disclaimer, the term of this patent is extended or adjusted under 35 U.S.C. 154(b) by 0 days.

(21) Appl. No.: 09/142,766

(22) PCT Filed: Jan. 19, 1998

(86) PCT No.: PCT/FR98/00086

§ 371 Date: Sep. 16, 1998

§ 102(e) Date: Sep. 16, 1998

(87) PCT Pub. No.: WO98/31985

PCT Pub. Date: Jul. 23, 1998

(30) Foreign Application Priority Data

Jan. 17, 1997 (FR) ..... 97 00497

(51) Int. Cl.[7] ..... F41G 3/22
(52) U.S. Cl. ..... 89/41.09; 89/41.14
(58) Field of Search ..... 89/41.09, 41.14

(56) References Cited

U.S. PATENT DOCUMENTS 4,012,989 3/1977 Hunt et al. ..... 89/41.09
5,392,688 * 2/1995 Boutet et al. ..... 89/41.09
5,440,492 * 8/1995 Kozah et al. ..... 364/454
5,568,152 * 10/1996 Janky et al. ..... 89/41.17
5,822,713 * 10/1998 Profeta ..... 364/559
5,834,677 * 11/1998 Muller ..... 89/41.17
6,041,508 * 3/2000 David ..... 42/100

FOREIGN PATENT DOCUMENTS 0 496 172 A1 7/1992 (EP) .
0 557 591 A1 9/1993 (EP) .
0 717 264 A1 6/1996 (EP) .

* cited by examiner

*Primary Examiner*—Stephen M. Johnson
(74) *Attorney, Agent, or Firm*—Oliff & Berridge, PLC

(57) ABSTRACT

The invention concerns the field of focusing and aiming instruments and more particularly a device for determining the direction of a target in a predetermined index mark comprising a focusing element, a resetting device for resetting the focusing element and a device for processing signals derived from the focusing element, the processing device determining values representing the direction between the focusing element and the target and transmitting the values to a display or an external system. The device is characterized in that the focusing element has a focusing member of three gyrometers arranged along three axes substantially perpendicular to one another and a controller that controls the transmission of the values representing the direction between the focusing element and the target to the display or to the external system.

22 Claims, 3 Drawing Sheets

DEVICE CAPABLE OF DETERMINING THE DIRECTION OF A TARGET IN A DEFINED FRAME OF REFERENCE

BACKGROUND OF THE INVENTION

The present invention concerns the field of sighting or aiming instruments. Its subject matter is more particularly a device capable of determining the direction of a target in a predefined frame of reference, the device having sighting means and means for processing signals derived from the sighting means, the processing means being capable of determining the direction between the sighting means and the target and transmitting them to imaging means or to external means.

Numerous devices exist which are capable of determining, in particular, the elevation and azimuth of a target.

For example EP 557 591 describes a device capable of determining the orientation of an object with respect to a reference orientation, and comprises a movable orientation unit and a reference sensor unit, each one of them having a three-axis gyroscopic unit, a calculation unit receiving measured values from the aforesaid units, and an output unit.

Many of these devices require substantial logistics. However, in certain circumstances it may prove necessary or indeed vital to use a lightweight and manageable device that can be used by a single operator.

Such devices exist, and use magnetic field sensors.

Among these devices, the binoculars sold under the LEICA trade name are capable of determining the elevation and azimuth of a target, and give complete satisfaction when used outdoors. They cannot be used, however, in an environment having magnetic disturbances.

Other devices analyze electrostatic or electromagnetic fields and, by reading their cartography, determining the position and direction of a target.

The devices are satisfactory in environments which are completely known and of small dimensions. They are difficult to use, however, and do not tolerate changes in the electrical environment.

Also known is U.S. Pat. No. 4,012,989, which describes a helicopter having a device for determining the direction of a target so as to direct a movable weapon system. The device for determining the direction of a target has a movable sighting member equipped with two integrated inertial gyroscopes, resetting means integral with the helicopter equipped with two gyroscopes, and means for slaving the direction of the weapon as a function of the data supplied by the gyroscopes. The resetting means serve to immobilize the four gyroscopes in a first reference position to define a frame of reference. When the sighting means are disengaged from the resetting means, the four gyroscopes are released. The gyroscope pair integrated with the resetting means then rotates as a function of the movements of the helicopter. The gyroscope pair integrated with the sighting member rotates as a function of the movements of the helicopter and the movements of the gunner controlling the sighting member. The weapon is directed in real time toward the target as a function of the difference in rotation between the two gyroscope pairs.

This device has numerous drawbacks. For example, the gunner is obliged to keep the sighting means continuously pointed toward the target until the weapon system is fired, which limits firing capabilities and makes the helicopter vulnerable if multiple targets are present. Because of helicopter vibrations and uncontrolled wrist movement, the two gyroscopes of the sighting means transmit to the processing means sequences of signal changes which cause an accumulating measurement error which impairs the accuracy with which the target direction is determined. On a ship, if the sea is rough and there is thus severe pitching and rolling, it would be almost impossible to orient the weapon system toward the target with such a device.

SUMMARY OF THE INVENTION

One of the purposes of the invention is to propose a lightweight and manageable device capable of accurately and rapidly determining the elevation and azimuth of a target, and usable regardless of the type of environment.

The solution proposed is a device capable of determining the direction of a target in a predefined frame of reference, and of the type having sighting means, means for resetting those sighting means, and means for processing signals derived from the sighting means, those processing means being capable of determining representative values of the direction between the sighting means and the target and transmitting them to imaging means or to external means, the device being characterized in that the sighting means have a sighting member, three gyrometers arranged along three axes that are substantially perpendicular to one another, and means for controlling the transmission, to the imaging means or external means, of values representing the direction between the sighting means and the target.

According to a particular advantageous characteristic, the device has three optical gyrometers, for example fiber-optic gyrometers.

According to a characteristic which limits the risk of damage to these gyroscopes, only their coils are arranged on the sighting means.

According to a particular characteristic which allows accurate positioning of the sighting means in the resetting means, the sighting means have elements capable of coacting with elements of the resetting means.

According to an additional characteristic, the first elements are constituted by three pads, one with a conical recess, the second having a plane surface, while the other elements are constituted by pins of conical shape.

According to one characteristic, the processing means have a source of electrical power and calculation and information management means using a software program which performs several functions.

According to a particular characteristic, the software program performs three principal functions:

- the target designation function, which acquires data from the sighting instrument and processes the data obtain the desired elevation and azimuth;
- the transmission function, which sends azimuth and elevation data for display on the imaging means and/or to a weapon system;
- the resetting function, which allows the drift of the sighting instrument due to the utilization of gyrometers to be corrected at regular intervals.

According to a particular characteristic, the software program additionally performs the function of displaying the operational state of the elements of the invention.

It is also known that the values emitted by the gyroscopes drift (change), particularly in terms of time and temperature, and the gyroscopes require static and dynamic calibration.

Patents EP 717 264 and EP 496 172 describe methods for correcting gyrometer biases and means for implementing them.

The former concerns the correction of gyrometer biases on an aircraft, and the latter on a vehicle. In both cases, gyroscopic calibration is performed when the aircraft or vehicle is in a stationary position.

To obtain good accuracy, however, it is necessary to compensate for gyroscopic drift at all times, and not just in a stationary position.

It is also known that a complex model of the trajectory of the gyroscopic data is needed to obtain good integration results. Signal processing means that are powerful and bulky, and thus not transportable, are used for that purpose.

One of the purposes of the invention is to propose a method for processing signals derived from gyroscopes which yields good results and does not require powerful signal processing means.

The solution consists in proposing a method for integrating gyroscope data consisting in performing in succession, based on gyroscope values obtained between a time t0 and time t1, first calculations using a complex model which, given the processing capacity of the processing means, cannot function in real time but does yield accurate results, and then, based on gyroscope values obtained between time t1 and t2, second calculations using a simplified model that can be implemented in real time.

According to another characteristic, the software program performs a function to correct the drift of the gyrometers between two successive resetting.

According to an additional characteristic, the sighting means have at least one temperature sensor.

BRIEF DESCRIPTION OF THE DRAWINGS

Other advantages and characteristics will become evident from the description of a particular embodiment in the context of operation on board a ship, and with reference to the attached drawings in which.

DETAILED DESCRIPTION OF THE PREFERRED EMBODIMENT

Figure 1:
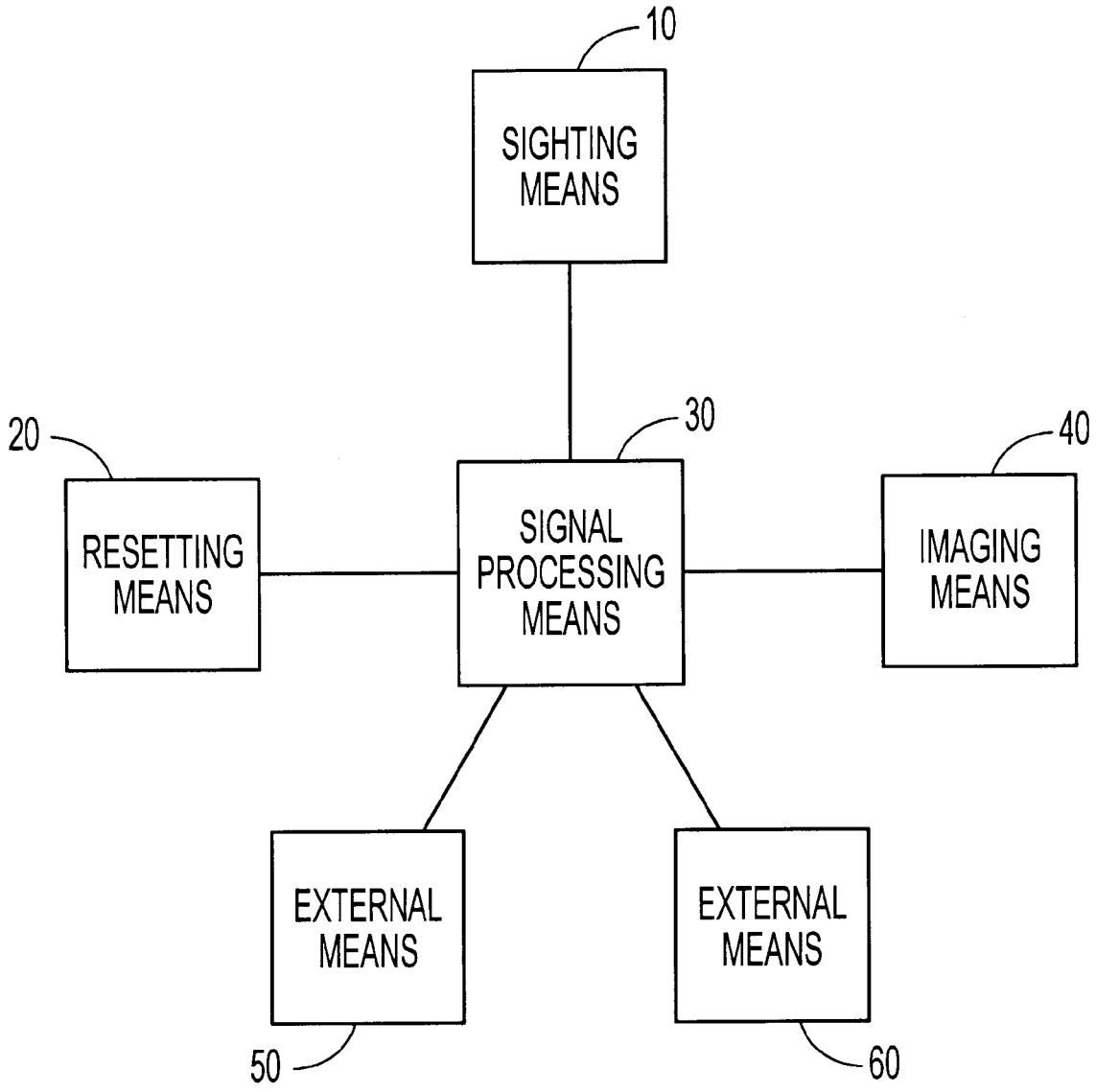
FIG. 1 is a block diagram of the general means according to the invention.

The means according to the invention depicted in FIG. 1 have sighting means 10, resetting means 20, signal processing means 30, imaging means 40, and external means 50, 60.

Figure 2:
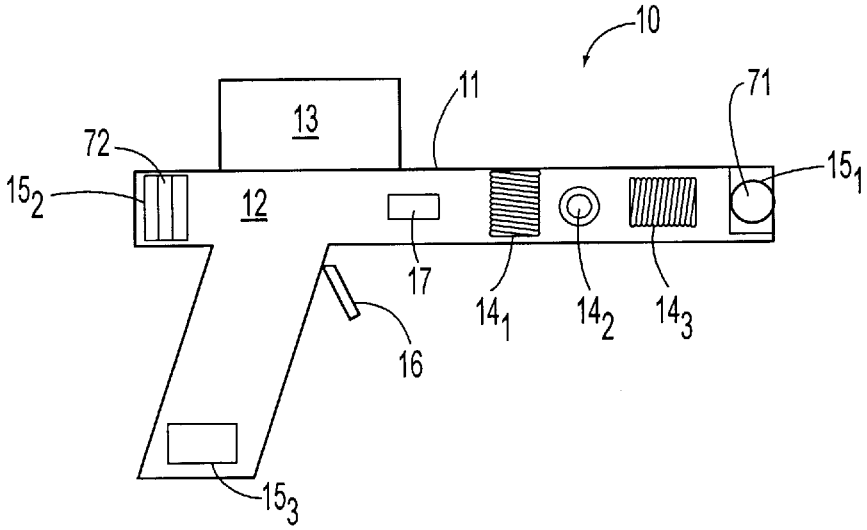
FIG. 2 depicts the sighting means according to the invention.

As shown in FIG. 2, sighting means 10 have means 11 in the form of a pistol. Barrel 12 thereof is a precision support made of lightweight material, for example machined aluminum, on which are positioned a sighting member 13 and along three axes which are substantially perpendicular to one another, three optical gyroscopes $\mathbf{14}_1$, $\mathbf{14}_2$, $\mathbf{14}_3$. Preferably the gyroscopes $\mathbf{14}_1$, $\mathbf{14}_2$ and $\mathbf{14}_3$ are fiber-optic gyrometers. They allow highly accurate measurements to be obtained, exhibit low drift, withstand rapid motion, and can be used in any environment.

These gyrometers output the rotation velocity about their axis, and make it possible, by step-by-step integration over time, to determine the position of means 11.

Sighting member 13 comprises a sight of the C-More brand which projects a reticle at infinity, thus allowing sighting without parallax error. Further, the means 11 mounts a temperature sensor 17.

Located on the right side of the pistol are three immovable pads $\mathbf{15}_1$, $\mathbf{15}_2$ and $\mathbf{15}_3$ made of steel which are used to position the pistol in the resetting means. The first pad $\mathbf{15}_1$, located at the end of the barrel, has a conical recess; the second pad $\mathbf{15}_2$ is located above the grip and has a groove or slot 72; the third pad $\mathbf{15}_3$, located at the base of the grip, has a plane surface. Alternatively, the conical recess 71 could be replaced by hole 71 penetrating the pad.

Orifices are machined into the means 11 to house the electrical systems and the three measurement gyrometers therein. The plane surfaces on which they rest and which determine their axes of rotation are machined to ensure they are perfectly perpendicular. These sighting means additionally have transmission control means constituted by a switch 16 in the form of a pistol trigger.

Figure 3:
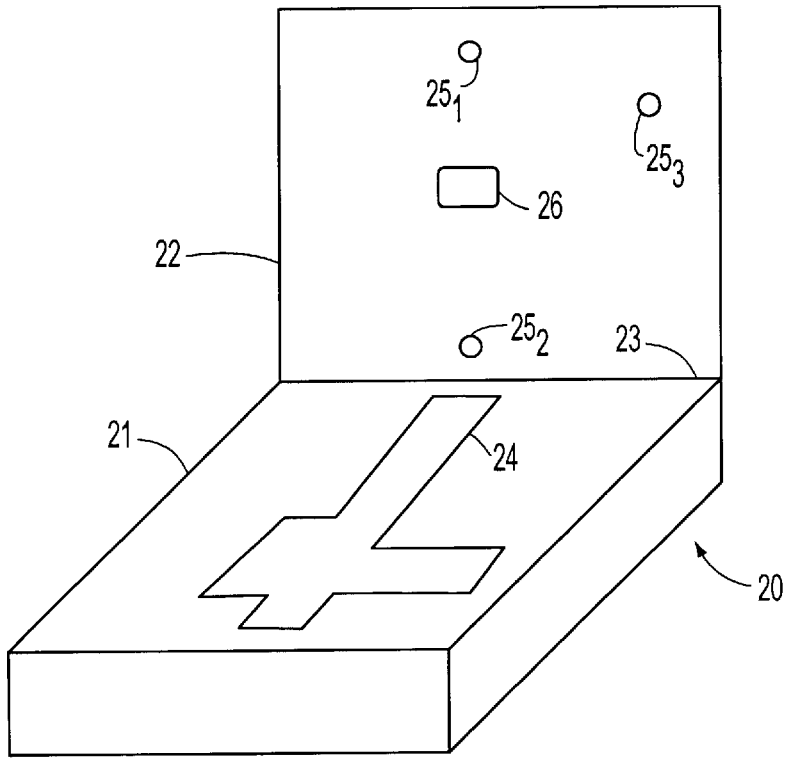
FIG. 3 illustrates the resetting means according to the invention.

Resetting means 20, depicted in FIG. 3, are attached to a ship, used as the exemplary platform for the extremes in conditions previously discussed, and comprise a support in the form of a parallelepipedal box 21 having a cover 22 which pivots about an axis 23. This box contains a sheath 24 which matches the shape of sighting means 10. The internal surface of face 22 has three fixed pins of conical shape $\mathbf{25}_1$, $\mathbf{25}_2$, and $\mathbf{25}_3$, arranged so that each of them coacts with one of the three immovable pads attached to the sighting means to ensure highly accurate positioning of the latter in the resetting means; the accuracy can be on the order of a hundredth of a degree or even better.

These resetting means moreover have a switch 26 which indicates whether sighting means 10 are present.

Processing means 30 are portable and have a stabilized electrical power supply and calculation and information management means which use a software program that performs several functions.

The external means comprise means 50 for measuring the attitude (heading, roll, pitch) of the ship, in this case a navigation unit, and the latitude of the latter on the surface of the earth. In this exemplifying embodiment, these data are transmitted to the sighting means 10 according to the invention by the ship's navigation means by way of a transfer function, in the form of data that can be used directly by the calculation means, to take into account the position of the navigation unit with respect to the resetting means.

The external means also comprises a weapon system 60, the aiming of which is controlled on the basis of the elevation and azimuth values determined by the sighting means 10 according to the invention, and of values pertaining to the weapon system and its location on the ship.

In the context of the invention, it is sufficient to determine the attitude of the sighting instrument in order to designate the target and thus determine the direction from sight to target.

The attitude can be expressed in various frames of reference depending on the needs of the system which will process the sighting information.

The reference frame may, in particular, be an absolute frame of reference whose axes are geographic east, geographic north, and the vertical of the location; or a frame of reference linked to the ship.

Calculation of the attitude may be broken down as follows:

When the sighting means 10 is positioned in the resetting means 20, their position is completely known in an absolute frame of reference, assuming a knowledge of the position of the resetting means 20 on the ship (six degrees of freedom), and the position of the ship in the geographic frame of reference linked to its fixed point (heading, roll, pitch, and latitude). These data are transmitted to processing means 30 by the ship's navigation unit.

the command to release the sighting means 10 from its resetting support 20 causes integration of the three incremental angles along each of the three axes linked to sighting means 10.

This integration takes place in a Galilean frame of reference linked to resetting support 20 in the position it occupied at the time sighting means 10 were extracted.

The attitude of the device is thus known at all times with respect to that Galilean frame of reference.

Nevertheless, the expression of the attitude of the sighting means must conform to the needs of external means 60.

In this embodiment, achieving this conformity requires two steps.

The first step comprises calculating the attitude of the sighting means 10 in a geographic frame of reference centered on resetting support 20 at the moment the information is used. This calculation takes into account the rotation of the earth and the elapsed time since the last resetting.

The second consists in expressing the attitude in the operating frame of reference, in this case the frame of reference of the weapon system.

This frame of reference can be located several tens of meters from the resetting support 20, and for that reason the parallax error may be non-negligible, especially if the objects being sighted are close, such objects can be swimmers or small vessels.

Once the operational need is known, the sighting field is separated into two domains. On is the domain of positive (or slightly negative) elevations, which cannot be floating targets. For these objects a default distance of approximately 4,000 meters is used to correct the parallax. The other domain is that of negative elevations, which are assumed to be floating targets. If the altitude of the device above sea level is known, and if the sighting elevation (measured by the device) is known, a simple trigonometric calculation can be used to estimate the distance of the object, and it is that distance which is used as the basis for calculating parallaxes.

In addition, movements of the sight due to operator tremors, in an environment which is both stressful and perturbed by movements of the ship, generate noise in the sighting datum which can make it difficult if not impossible to process.

To eliminate this drawback, a data filtration program is built in so as to stabilize the output signal. This filtration can be of the low-pass type or a KALMANN filter, in order to take into account target maneuvers in a given envelope without trailing.

Since the movement can be fairly rapid, and the incremental angles measured by the measurement system fairly large, a suitable model can return conditions to the previous state.

The initial attitude is determined mechanically. Prior to any designation of the target, the sighting instrument is at rest in the resetting means so that its position is known and reproducible. The accuracy of that position results from three fixed positioning pins $\mathbf{25}_1$, $\mathbf{25}_2$, and $\mathbf{25}_3$ in the support, which are inserted successively into one of the pads arranged on the sighting means 10. The six degrees of freedom having thus been determined with great accuracy, the initial attitude of the sighting instrument is completely known.

It must be noted that positioning of the sighting means 10 in the resetting means 20 is accomplished in two stages. The first consists of positioning the sighting means 20 in sheath 24; this constitutes a positioning which may be regarded as coarse. The second consists in positioning the sighting means by successively inserting one of the three pins into one of the three pads which results in positioning to within a hundredth of a degree. Given the position of pins $\mathbf{25}_1$, $\mathbf{25}_2$, and $\mathbf{25}_3$ on cover 22, precise positioning of the sighting means is accomplished automatically when the cover 22 of box 21 is closed.

The purpose of the software program use by processing means 30 is to process the raw data supplied by the sighting instrument, a device which allows the operator of the sighting means 10 to sight on a target and determine its elevation and azimuth.

This software program performs the following four functions:

- target designation function, which causes data to be acquired from the sighting means 10 and processes them to obtain the desired elevation and azimuth;
- transmission function, which sends the azimuth and elevation data for display on the imaging means and/or for the control of weapon system 60;
- resetting function, which allows correction at regular intervals of the sighting means' drift due to the use of gyrometers;
- imaging function, which displays the operational state of the elements according to the invention.

The target designation function takes place continuously when the sighting means 10 is in an operational mode, i.e. outside the resetting support 20. The time required to process the gyroscopic data must be minimal, for example on the order of a few milliseconds, to allow processing of as much data as possible coming from the gyrometers, and thus to allow better tracking of the change in the angular increments and the angles deducted therefrom as to limit errors during processing. Depending on the size of the angular increments derived from the gyrometers, a model is established to gain as much independence as possible from the commutativity limits of rotations in space.

The input values required for this function are:

The angular increments derived from the gyrometers: dqx(t), dqy(t), dqz(t);

u, v, w, which are position vectors of the sighting means 10 at time t-dt in the absolute frame of reference of the resetting support 20 at t0 (time of the last resetting).

The output values are:

u, v, w: position vectors of the sighting means 10 at time t in the absolute frame of reference of the resetting support 20 at t0;

Elevation S and azimuth A in the absolute frame of reference at t.

Integration of the gyrometric data is accomplished in the absolute frame of reference of the resetting support at t0. At the time of sighting, when the trigger is pressed, processing is terminated by taking into account the rotation of the earth that has additionally been measured by the gyrometers since processing began. This is done by operating in the absolute frame of reference of the resetting support at t, the time of sighting, then subtracting the absolute elevation and azimuth of the sighting instrument with respect to the ship.

Correction of the gyrometric data is performed as follows:

The three gyrometers supply: Sdqx(t), Sdqy(t), Sdqz(t).

It is easy to calculate dqx(t), dqy(t), and dqz(t):

$$dqx(t)=Sdqx(t)-Sdqx(t-dt).$$

The same applies to dqy(t) and dqz(t).

After the multiple corrections are performed in known fashion at this level, such as compensation for gyrometer drift as a function of time, temperature, noise filtration, etc., the data of interest—dqu(t), dqv(t), dqw(t)—are integrated according to the method described above.

The transmission function is very simple, as it consists of sending calculated values for elevation and azimuth in the absolute frame of reference of the ship at time t to a memory and to the weapon system and/or for display on to the imaging means for display.

This function is activated by moving switch 16 from the open position to the closed position. It is accompanied by issuance of an audible signal and/or a light signal, and display of a positive datum on the imaging means.

While the switch 16 is closed, an automatic resetting takes place periodically and the gyrometer drifts are analyzed in terms of both time and temperature. If the switch opens during processing, the resetting that is in progress is concealed, and the values from the previous resetting are used.

The input values are:

position of switch 26;

values derived from external means 50;

the position of the sighting instrument (U0, V0, W0) in the relative frame of reference of the ship when the sighting instrument is in the resetting support 20; k, r, t (heading, roll, pitch of the sighting instrument with respect to the vessel, determined during calibration of the support).

The output values are: t0, u0, v0, w0, the position vectors of the sighting instrument at t0, as well as Du.

Processing of the input data is accomplished as follows:

The values for heading K, roll Rr, and pitch Ta of the vessel are acquired.

At initialization of the program, the position of the resetting support 20 with respect to the ship is entered as the parameter. The position of the sighting means 10 in its resetting support 20 (ur, vr, wr) is also known. This makes it possible to determine the position of the sighting means 10 when it is in its resetting support 20, in the relative frame of reference of the ship.

The calculations during processing are accomplished in the absolute frame of reference of the ship (and of the resetting support 20) at t0, the time of the last resetting. The purpose of the resetting is thus to determine the new starting vectors for the integral in the absolute frame of reference of the resetting support 20 at t0.

To display a representative value for the drift of the gyrometers during the last operational phase, it is necessary to know, in the absolute frame of reference of the resetting support 20 at time t01 (the time at which the sighting instrument was placed in its support), the vector v calculated after processing of the gyrometric data, and v0, the reference vector determined from the ship's navigation unit.

The following calculation is performed to determine the drift.

The frame of reference is the absolute frame of reference of the resetting support at t0, the time at which the sighting instrument was just placed in its support (t01).

The elevation and azimuth are calculated using the sighting vector determined by the gyrometric measurements and integration during operational mode.

These values are compared to those calculated from the sighting vector determined by the ship's navigation unit and the known position of the sighting means 10 when it is in its resetting support 20.

The system status imaging function makes it possible to display the status of certain functions:

transmissions from the gyrometers to the computer;

transmissions of values derived from the external means;

transmission from the trigger to the computer;

transmission from the resetting sensor to the computer;

as well as certain values such as the calculated elevation and azimuth, the heading, roll, pitch, and latitude values, as well as the time, the time of last resetting, the most recent length of time in use since resetting, the observed drift, etc.

To test the reception of data from the gyrometers, it is necessary to verify that the gyrometric data are in fact arriving at the processing unit every Dt. If no data has arrived at the processing unit after 3 Dt, a fault is detected, and the "transmission from gyrometers" variable switches from 1 to 0.

The same principle is used to test the transmission of values from the external means.

When the trigger is pulled, switch 16 closes and the "trigger" variable switches from 0 to 1 on the screen.

In the same fashion, when switch 26 is closed the "reset" variable switches from 0 to 1 on the screen.

The sighting means 10 according to the invention are used by an operator. When the latter sees a target, he removes sighting means 10 from resetting means 20, then uses sighting member 13 to point sighting means 10 in the direction of the target, and presses switch 16 when he considers that sighting member 13 is correctly positioned with respect to the target. Means 30 then calculates the elevation and azimuth of the target and transmit those values to the weapon system, which causes orientation of the weapon as a function of those values and changes in the attitude of the ship since said transmission of values, those changes being determined, as mentioned above, by means 50.

Immediately after the transmission, the operator can sight on another target and press switch 16. Means 30 then calculates the elevation and azimuth of the new target, and transmit those values to the weapon system which stores the values in memory and can orient the weapon toward that new target immediately after firing toward the first target.

The gunner can thus sight on several targets in succession in a minimal time without being obliged to wait for the end of the weapon firing sequence, which optimizes the total time required for such firings and thus decreases the vulnerability of the ship.

It also gives the operator the ability to re-sight on a target if the weapon's projectile did not hit it, even if the weapon system is oriented toward another target.

In addition, after acquiring the target or the various targets, the gunner can perform complementary tasks or can move without having the weapon system react to his movements.

Acquisition of the gyrometers is performed at a timing interval Dt of between 5 ms and 100 ms. These values are integrated, and it is known to model that integration so as to obtain accurate results. With portable calculating means, however, it is not possible to perform calculations in real time. One of the purposes of the invention is to solve this problem by proposing an integration method consisting of performing successively, on the basis of the gyroscopic values obtained between time t0 and time t1, first calculations using a complex model which cannot operate in real time but does give accurate results; then, based on the gyroscopic values obtained between time t1 and time t2, second calculations using a simplified model capable of being used in real time.

The advantage of this succession of steps is that it can yield elevation and azimuth calculations is real time with respect to the closure of switch 16 and, with that objective in mind, gives more accurate results than the use of only the complex mode or the simplified model alone.

It is evident that numerous modifications can be made to the embodiment presented. For example, box 21 can be replaced by a device having actuators of, for example, the electromechanical or pneumatic type.

sighting means 10 are placed in a support of the case type. They are thereby positioned to within a few degrees.

Upon detection of their presence, a pneumatic or electromechanical device presses them against the three pins described previously.

In so doing, they are automatically positioned to within a hundredth of a degree thanks to the action of the three pins with the three pads. Resetting then occurs.

In addition, the sighting means can be applied to helmets such as the one described in U.S. Pat. No. 4,722,601, to a headband, or to binoculars, and the software program can have a self-adapting algorithm for calculating the drift of the gyrometers.

Figure 4:
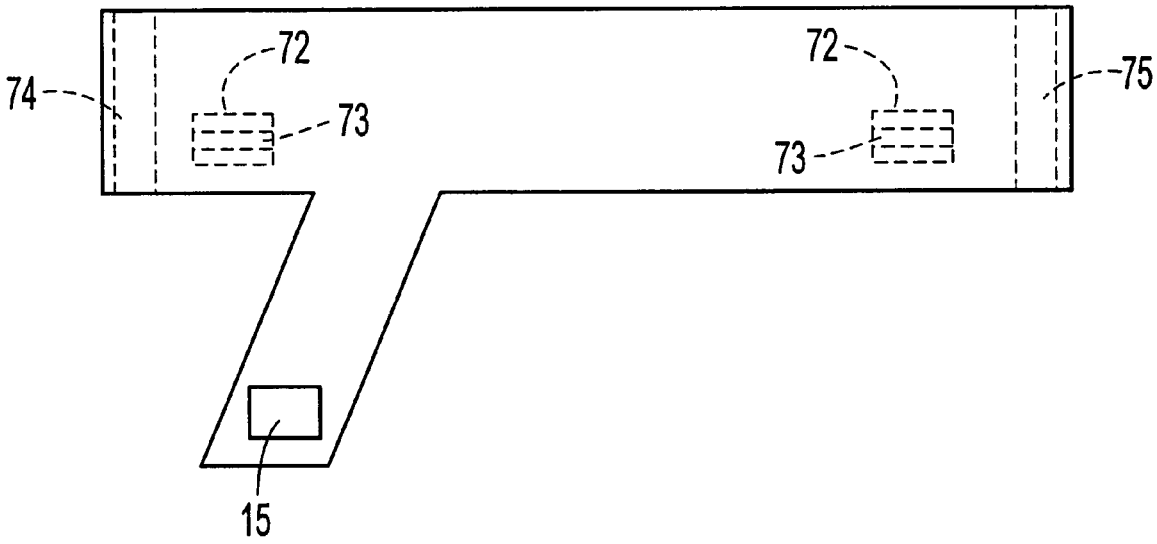
FIG. 4 depicts another embodiment of the sighting means.

With regard to elements 15, 25 for positioning the sighting means 10 in the resetting means 20, the three pads can each have a slot, or the means can also have four pads (FIG. 4) of which tow 72, 72 have a slot 73, the third 74 has a stop, and the fourth 75 forms one plane.

What is claimed is:

1. A device for determining a direction of a target in a predefined frame of reference, comprising:

sighting means for sighting on the target;

means for resetting said sighting means; and means for processing signals derived from the sighting means, said processing means determining the direction between the sighting means and the target and transmitting values representing the direction between the sighting means and the target to imaging means or to external means, wherein the sighting means comprise:

a sighting member;

three gyrometers arranged along three axes that are substantially perpendicular to one another; and means for controlling the transmission, to the imaging means or external means, or the values representing the direction between the sighting means and the target.

2. The device as defined in claim 1, wherein the gyrometers are three optical gyrometers.

3. The device as defined in claim 2, wherein the optical gyrometers are fiber-optic gyrometers.

4. The device as defined in claim 3, wherein only the coil of each of the fiber-optic gyrometers is arranged on the sighting means.

5. The device as defined in claim 1, wherein the sighting means have first elements that coact with second elements of the resetting means.

6. The device as defined in claim 5, wherein the first elements comprise three pads, one penetrated by a hole, the second having a slot, and the third forming a plane surface.

7. The device as defined in claim 5, wherein the first elements comprise three pads each having a slot.

8. The device as defined in claim 5, wherein the first elements comprise four pads, two having a slot, the third exhibiting a stop, and the fourth forming one plane.

9. The device as defined in claim 5, wherein the second elements comprise pins of conical shape.

10. The device as defined in claim 2 wherein the resetting means have means for approximately positioning the sighting means, as well as means for precisely positioning the sighting means.

11. The device as defined in claim 10, wherein the approximately positioning means comprise a sheath.

12. The device as defined in claim 10, wherein the precisely positioning means comprise a cover.

13. The device as defined in claim 10, wherein the precisely positioning means further comprise at least one actuator.

14. The device as defined in claim 1, wherein the sighting means have a temperature sensor.

15. The device as defined in claim 1, wherein the processing means have a source of electrical power and comprise calculation and information management means for using a software program for performing multiple functions.

16. The device as defined in claim 15, wherein the software program performs, in particular:

a target designation function, which causes acquisition of data from the device and processes the data to obtain the desired elevation and azimuth to the target;

a transmission function, which provides the azimuth and elevation to at least one of the imaging means for display and a weapon system;

a resetting function, which allows drift of the device due to the use of gyrometers to be corrected at regular intervals.

17. The device as defined in claim 16, wherein the software program additionally performs a function of displaying the operational state of the elements of the device.

18. The device as defined in claim 16, wherein the software program performs a function of correcting the drift of the gyrometers between two successive resetting.

19. The device as defined in claim 18, wherein the software program for correcting the drift is of the self-adapting type.

20. The device as defined in claim 16, wherein the software program performs a noise filtration function.

21. The device as defined in claim 1, wherein the sighting means have a sighting member comprising a sight which projects a reticle at infinity.

22. A method for integrating the gyroscopic data derived from the sighting means of the device as defined in claim 1, comprising performing in succession the steps of:

obtaining gyroscope values between a time t0 and a time t1;

making first calculations based on the t0–t1 gyroscope values using a complex model which, given the processing capacity of the processing means, cannot function in real time but does yield accurate results;

obtaining gyroscope values between time t1 and time t2; and making second calculation based on the t1–t2 gyroscope values using a simplified model that can be implemented in real time.

* * * * *